United States Patent [19]

Takahashi

[11] Patent Number: 4,580,019

[45] Date of Patent: Apr. 1, 1986

[54] PUSH-ROTATION TYPE KEY SWITCH DEVICE

[75] Inventor: Tetsuo Takahashi, Tokyo, Japan

[73] Assignee: Takigen Seizou Co., Ltd., Tokyo, Japan

[21] Appl. No.: 604,839

[22] Filed: Apr. 27, 1984

[51] Int. Cl.[4] ..... H01H 27/06

[52] U.S. Cl. ..... 200/43.08; 200/153 T; 200/153 LB

[58] Field of Search ..... 200/44, 43.08, 153 T, 200/153 LB, 331; 70/DIG. 30

[56] References Cited

U.S. PATENT DOCUMENTS

| | | | |
|---|---|---|---|
| 3,304,380 | 2/1967 | Mitchell | 200/44 |
| 3,385,086 | 5/1968 | Patriquin | 200/44 X |
| 3,723,677 | 3/1973 | Arias | 200/44 |
| 3,874,282 | 4/1975 | Oouchi | 200/44 X |
| 3,902,027 | 8/1975 | Hollins | 200/44 |
| 3,912,888 | 10/1975 | Takahashi | 200/44 |
| 4,146,761 | 3/1979 | Sung | 200/44 |
| 4,276,453 | 6/1981 | Wolter | 200/44 |

FOREIGN PATENT DOCUMENTS

| | | | |
|---|---|---|---|
| 2402291 | 4/1979 | France | 200/44 |
| 1456739 | 11/1976 | United Kingdom | 200/44 |

*Primary Examiner*—Stephen Marcus
*Assistant Examiner*—Ernest G. Cusick
*Attorney, Agent, or Firm*—Martin Smolowitz

[57] ABSTRACT

Disclosed herein is a push-rotation type key switch device which consists essentially of a lock main body having a rotor which is not capable of sliding in an axial direction, a switch fitted to the rear of the lock main body and a switch operating cam caused to slide backward in the axial direction of the rotor when a key is inserted into the rotor. When the cam is rotated integrally with the rotor in either normal or reverse direction, the switch is turned on and off.

1 Claim, 13 Drawing Figures

PUSH-ROTATION TYPE KEY SWITCH DEVICE

BACKGROUND OF THE INVENTION

This invention relates to a key switch device of a type in which a switch is fitted to the rear of a lock main body and the on-off operation of the switch is allowed only to a person who keeps the key of the lock.

In a conventional rotor-push type key switch device disclosed in Japanese Utility Model Laid-Open No. 4563/1982, a key is first inserted into a rotor to unlock the rotor from a lock main body, the key is then pushed so as to move the rotor backwards in its axial direction, and a switch fitted to the rear of the lock main body is operated by use of a switch operating cam disposed at the rear end of the rotor. According to this construction, however, lock of the rotor can be released by fake picking means other than the key, such as a needle or a rod, and the switch can be easily turned on by pushing the rotor with a finger. Thus, the reliability of this key switch device is not entirely high.

SUMMARY OF THE INVENTION

The present invention is therefore directed to provide a push-rotation type key switch device having remarkably improved reliability, because the on-off operation of its switch can be made only by a person who keeps the key.

BRIEF DESCRIPTION OF THE DRAWINGS

The accompanying drawings illustrate preferred embodiments of the invention, in which:

FIG. 9 is a front view showing the relation of position between the auxiliary cam and an actuator when the cam is rotated by 90° in the normal direction and the switch is turned on;

DESCRIPTION OF THE PREFERRED EMBODIMENTS

Figure 1:
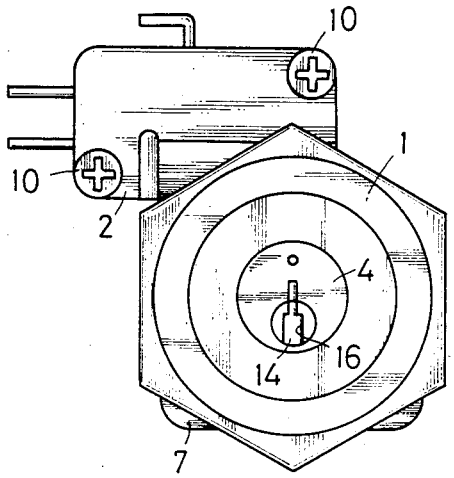
FIG. 1 is a front view of a key switch device.

Hereinafter, preferred embodiments of the present invention will be described with reference to the accompanying drawings.

Briefly stated, the gist of the present invention resides in that only an operating cam 3 for a switch 2 fitted to the rear of a lock main body 1 is pushed and slid backwards in the axial direction of a rotor 4 by a key 6 inserted into the rotor 4, and when the cam 3 rotates integrally with the rotor 4 in either direction, the switch 2 is turned on or off.

In the embodiment shown, a fitting base plate 7 is fixedly secured to the rear of the lock main body 1 by a screw 8, and a micro-switch type switch 2 is fixed to the fitting base plate 7 by a rear seat plate 9 in cooperation with a nut 10. The lock main body 1 is fixed to an equipment panel 5 by a nut. A switch operating cam 3 having a short cylindrical form is equipped on its peripheral side surface with a cam protuberance 12 which pushes an actuator 11 of the switch 2. A split groove 13 is defined on the cam 3 in its radial direction, and an interlocking plate 14 is inserted into this groove 13 in the axial direction of the cam. The interlocking plate 14 is fixed to the cam 3 by a spring pin 15. The front end portion **14*a* of the interlocking plate 14 is slidably inserted into the rear end portion of a key groove 16 of the rotor 4**.

The cam 3 is equipped with a cylinder portion 17 of a small diameter at the center of its rear surface, and the cylinder portion 17 incorporates therein a compression spring 18 and a small ball 19. The small ball 19 is in contact with a receiving seat hole 20 of the rear seat plate 9. The cam 3 is urged by the compression spring 18 towards the rear surface of the lock main body 1. In this embodiment, the compression spring 18 does not directly come into contact with the seat plate 9, but the small ball 19 is interposed between them. Accordingly, friction or catch does not occur between the end portion of the spring and the surface of the seat plate, and the cam 3 can be rotated lightly and smoothly without any large resistance. The spring 18 serves also as the locating means for the cam 3. Since the spring 18 is incorporated in the cam 3 itself but does not protrude on the back of the seat plate, the entire length of the key swtich device can be shortened and the device can be made compact as a whole.

In this embodiment, an auxiliary cam 21 is rotatably fitted into a center shaft hole 25 of the small diameter cylinder portion 17 of the cam 3, and a leaf spring 23 having substantially a horseshoe shape is fixed by a screw 24 to the inner bottom surface of a front circular recess 22 of the auxiliary cam 21. One end **23*a* of the ends of this leaf spring 23 floats up slantingly from the inner bottom surface of the recess 22. The rear end protuberance 14*b* of the interlocking plate 14, that projects from the rear surface of the cam 3, can engage with and disengage from this spring end portion 23*a*. A compression spring 26 is interposed between the cam 3 and the auxiliary cam 21 so that the spring 26 urges and slides the cam 3 towards the rear surface of the lock main body 1, while the auxiliary cam 21 is urged to slide towards the rear seat plate 9. A twist coil spring 28 is inserted into the center cylinder portion 27 of the auxiliary cam 21 which is in pressure contact with the rear seat plate 9, and one end 28*a* of the ends of this spring 28 is anchored to the screw 24 described above which protrudes on the rear surface of the auxiliary cam 21. The other end 28*b* of the spring 28 is fixed to a left rod 29 of two locating rods 29, 30 that are stretched in parallel with each other between the fitting base plate 7 and the rear seat plate 9 and are fastened by nuts 31, respectively. The tip portion of the screw 24 described above is inserted into an arcuate elongated hole 32 which is disposed on the rear seat plate 9** and has a center angle of 90°.

Figure 2:
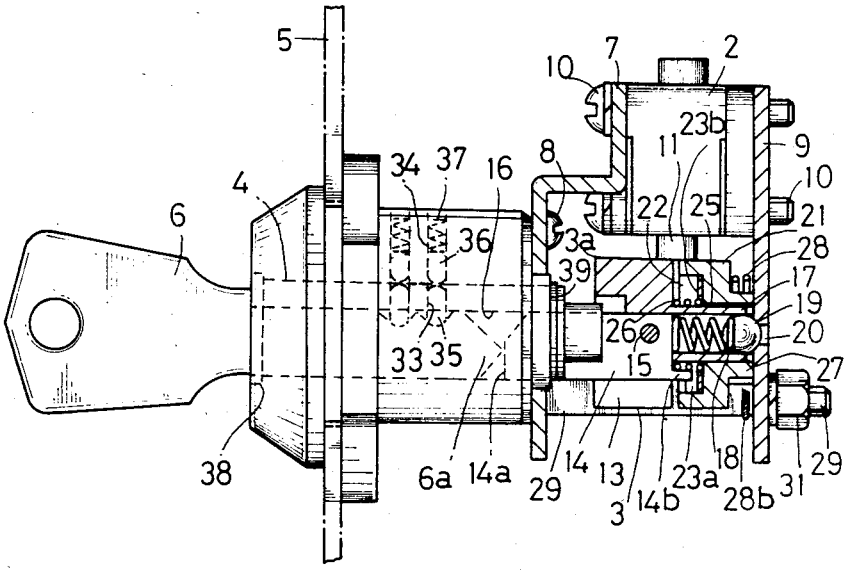
FIG. 2 is a right-hand side view with a part of the device being shown in a longitudinal section.
Figure 3:
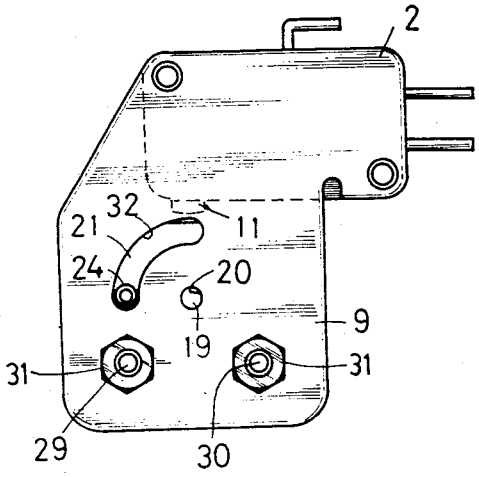
FIG. 3 is a rear view of the key switch device.
Figure 4:
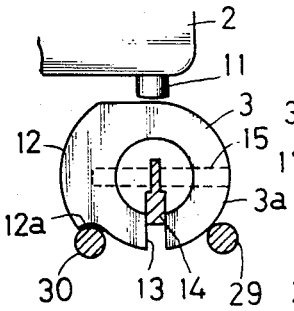
FIG. 4 is a front view of a cam used for the key switch device.
Figure 5:
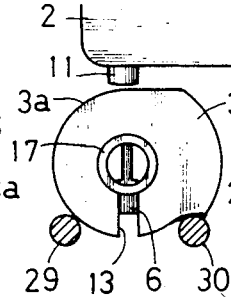
FIG. 5 is a rear view of the cam.

When the key 6 is inserted into the key groove 16 of the rotor 4 in a predetermined length in the key switch device of this embodiment, the follower and driving pins 35 and 36 that are stored in the pin receiving hole 33 of the rotor 4 and in the pin receiving hole 34 of the lock main body 1, respectively, slide against the force of the compression coil springs 37, and the contact surface of both pins 35 and 36 coincides with the outer peripheral surface of the rotor 4. Accordingly, the rotor 4 is unlocked from the lock main body 1 and becomes rotatable. The rotor 4 is prevented from sliding in its axial direction by its front flange portion 38 and by a fall preventing ring 39 at its rear end. Accordingly, when the key 6 is further pushed in, only the interlocking plate 14 is pushed by the tip 6*a* of the key and moves backwards within the key groove 16. This causes the cam 3, which is interconnected to the interlocking plate 14, to move backwards while compressing the compression spring 26, and comes to the position where its peripheral side surface 3*a* faces the actuator 11 of the switch, as shown in FIGS. 2 and 4. When the key is rotated clockwise by 90° at this position in FIG. 1, the interlocking plate 14 and the cam 3 rotate integrally with the rotor 4, so that the cam 3 pushes the actuator 11 by its projection 12 on its peripheral side surface, thereby turning on the switch 2.

Figure 9:
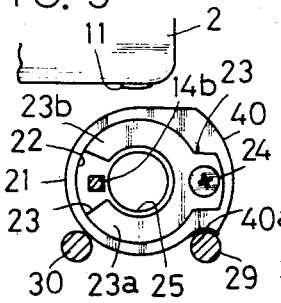

When the cam 3 slides backwards by the push operation of the key 6 described above, the rear end protuberance 14*b* of the interlocking plate 14, that comes into the front recess 22 of the auxiliary cam 21, rotates while pushing the front surface of the inclined end portion 23*a* of the horseshoe spring 23, when the cam 3 is rotated normally by 90° C. At the end of rotation, protuberance 14*b* falls into the space between spring end portions 23*a* and 23*b* as shown in FIG. 9. Next, when the key is rotated counter-clockwise in the reverse direction in FIG. 1, the cam 3 stops rotating as the side surface portion 12*a* of the cam protuberance 12 butts against the locating rod 30. At this stage, the actuator 11 is released from being pushed by the cam protuberance 12, but the switch 2 is still kept in the ON state for the following reason.

Figure 7:
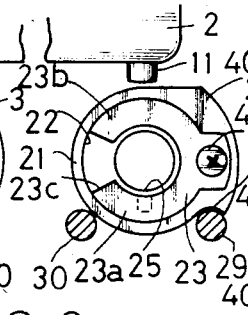
FIG. 7 is a front view of an auxiliary cam used for the key switch device shown in FIG. 1.
Figure 8:
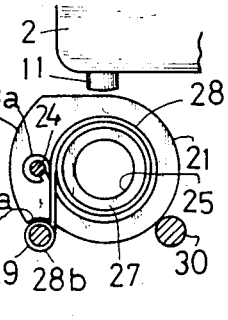
FIG. 8 is a rear view of the auxiliary cam.
Figure 6:
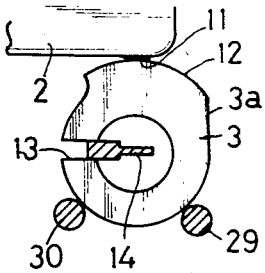
FIG. 6 is a front view of the cam when it is rotated by 90° in the normal rotating direction.
Figure 10:
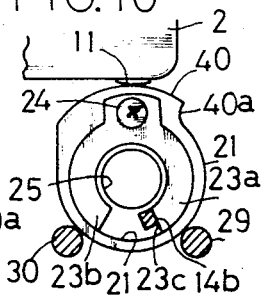
FIG. 10 is a front view of the auxiliary cam when it is rotated by 90°.

When the cam is rotated in the reverse direction by 90°, the rear end protuberance 14*b* of the interlocking plate 14 floats up and pushes the end surface 23*c* of the spring end portion 23*a*, so that the auxiliary cam 21 rotates integrally with the cam 3 as shown in FIG. 10, and the cam protuberance 40 of the auxiliary cam 21 engages with the actuator 11 before the cam protuberance 12 of the cam 3 disengages from the actuator 11. Thus, the actuator 11 is kept at the push position. When this auxiliary cam 21 is rotated by 90°, the twist coil spring 28 is wound and undergoes deformation, and hence the auxiliary cam 21 is urged to rotate clockwise in FIG. 10. When the pushing force by the key 6 to the interlocking plate 14 and to the cam 3 is now released, the cam 3 is moved towards the rear surface of the lock main body 1 by the repulsive force of the compression coil spring 26 and the rear end protuberance 14*b* of the interlocking plate 14 disengages from the end surface 23*c* of the end portion 23*a* of the horseshoes spring. Immediately after this release, the auxiliary cam 21 is urged for rotation by the coil spring 28, and stops rotating when the side surface 40*a* of the cam protuberance 40 butts against the locating rod 29 as shown in FIG. 7.

Figure 11:
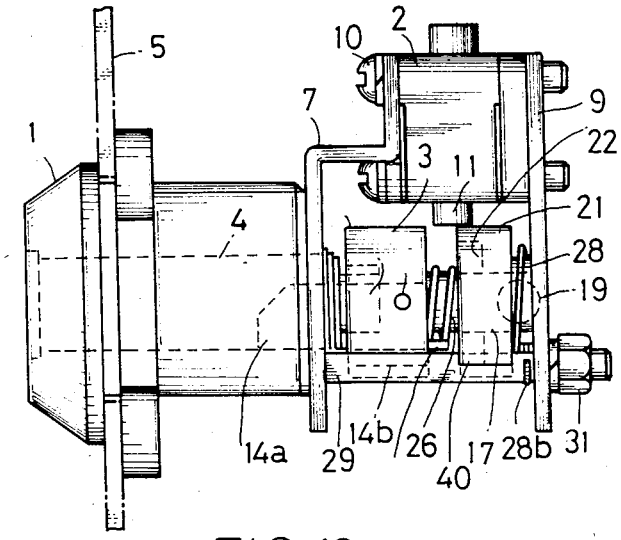
FIG. 11 is a right-hand side view of the key switch device with a part thereof shown in a longitudinal section, when the key is removed therefrom.

When the key 6 is removed, the cam 3 and the auxiliary cam 21 move forward to the position shown in FIG. 11, and the cam 3 does not at all confront the actuator 11. Although the auxiliary cam 21 confronts the actuator 11, its cam protuberance 40 does not at all push the actuator 11 as shown in FIG. 7.

In the key switch device of the embodiment described above, there is provided the auxiliary cam 21 which follows up the rotation of the cam 3 when the cam 3 rotates in the reverse rotation, and is equipped with the cam protuberance 40 which takes over the push operation of the actuator by the cam protuberance 12 of the cam 3 before the cam protuberance 12 of the cam 3 stops pushing the actuator 11. According to this construction, even when the push operation of the key 6 is stopped, the switch 2 is kept in the ON state during the period in which the auxiliary cam 21 rotates in the reverse direction. Thus, it is possible to reliably keep the switch ON for a predetermined period of time required by the equipment to which the key switch device is applied.

Figure 12:
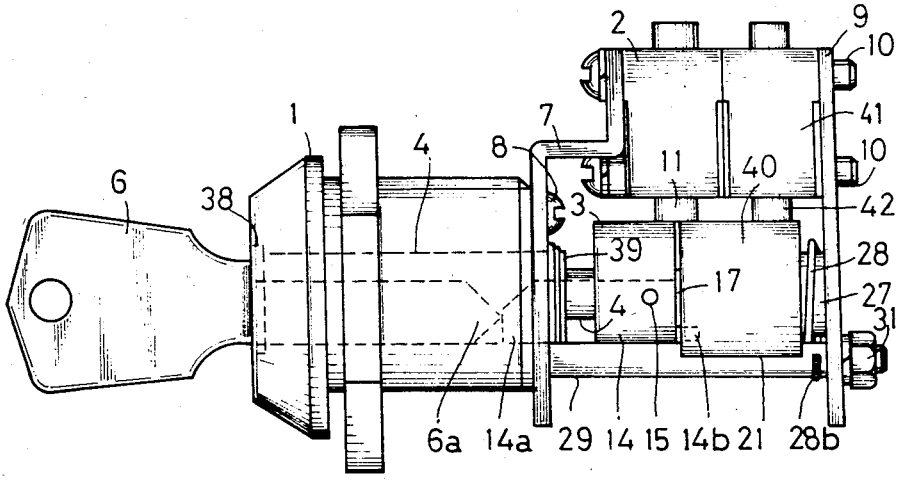
FIG. 12 is a right-hand side view showing the relation of position between the cam, the auxiliary cam and the switch in a key switch device in accordance with another embodiment of the present invention.

In a modified embodiment shown in FIG. 12, the dimension of the auxiliary cam 21 in its axial direction, that is, its thickness, is increased, so that an actuator 42 of another switch 41, juxtaposed with the switch 2 on its rear side, can be pushed. This arrangement makes it possible to turn on the separate switch 41 while the switch 2 is kept turned on, that is, immediately before the switch 2 is turned off. The auxiliary cam for the push operation of the acutators of the two switches can be laminated and interconnected at an arbitrary number of stages.

Figure 13A:
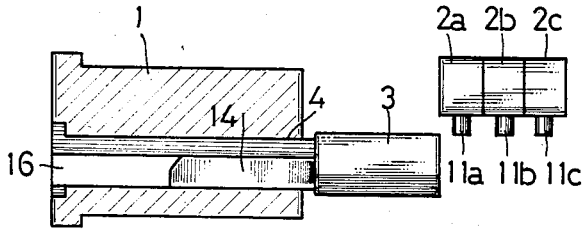
FIG. 13 is a schematic right-hand side view showing the relation of position between the key, the switch and the cam in a key switch device in accordance with still another embodiment of the present invention.
Figure 13B:
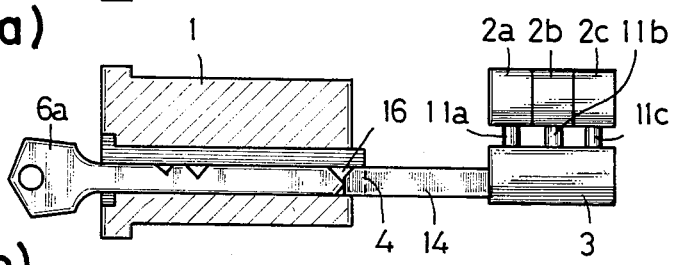
Figure 13:
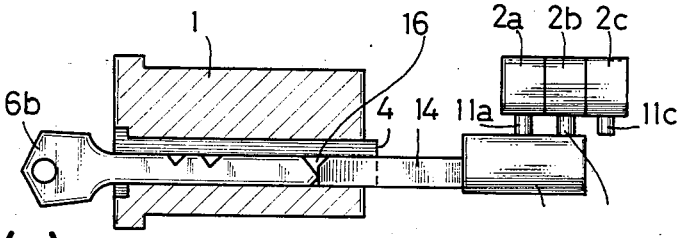
Figure 13D:
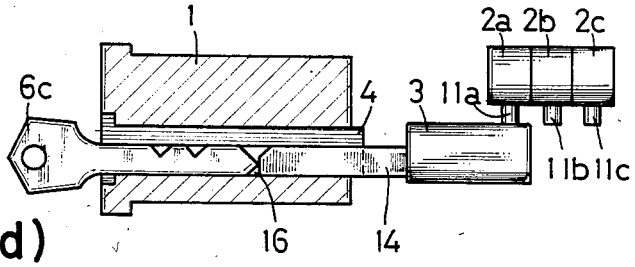

As shown in FIG. 13, it is also possible to change the number of operations of the switches 2*a*, 2*b*, 2*c*, . . . , that can be turned on and off, in accordance with the authority given to the person who keeps the key, by changing the length of the key as shown in FIGS. 13(*a*) through 13(*d*). FIG. 13(*a*) shows the state in which the key 6 is not inserted into the key groove. FIG. 13(*b*) shows the state in which the key 6*a* capable of turning on and off all the three switches 2*a*, 2*b*, 2*c* are pushed. FIG. 13(*c*) shows the state in which the key 6*b* capable of turning on and off two front switches 2*a*, 2*b* is pushed. In FIG. 13(*d*), the key 6*c* capable of turning on and off only the front switch 2*a* is shown pushed. Accordingly, the key 6*a* is the longest and the key 6*c* is the shortest, and the backward sliding quantity of the operating cam 3 is varied in accordance with the key lengths.

As described above, in the key switch device of the present invention, the rotor 4 of the lock main body 1 can not slide in the axial direction, whereas the cam 3 for operating the switch 2 fitted to the rear of the lock main body 1 can slide backward by the key 6 inserted into the rotor 4. When the cam 3 rotates integrally with the rotor 4 in either direction, therefore, the switch 2 is turned on and off. Unlike the prior art devices, even if lock of the rotor 4 to the lock main body 1 is unlocked by picking means such as a needle or a rod, the subsequent rotating operation is extremely difficult or impossible. According to the present invention, it is possible to reliably prevent a fake or unfair switch operation by those who do not keep the key other than the normal key holder, and thus to obtain a key switch device having high safety.

The present invention can be worked in various embodiments. For example, the numbers of the switches, cams 3 and auxiliary cams 21 is not necessarily limited to those shown in the drawings, but can be appropriately selected in accordance with the intended application of the key switch device. The switch is not particularly limited to the normally-open contact type, but a normally-closed type can also be used. In such a case, the ON operation in the foregoing description should be replaced by the OFF operation, and vice versa. The switch 2 is not particularly limited to the microswitch type, but a proximity type switch such as a magnetic lead switch and a photoelectric switch can also be employed. In such a case, the cam protuberances 12, 40 of the cam and auxiliary cam 3, 21 are replaced by magnets or ferromagnets or by light-emitting or light-receiving elements. The lock mechanism of the rotor 4 to the lock main body 1 is not limited to the pin tumbler mechanism described earlier, in particular.

What is claimed is:

1. A push-rotation type key switch device, comprising: a lock main body having front and rear portions and a rotor rotatable in the body and not capable of sliding in an axial direction therein; said rotor containing follower and driving pins stored in pin receiving holes in the rotor; a switch fitted to the rear portion of said lock main body, said switch being fixed between a fitting base plate and a rear seat plate of said main lock body and having an actuator; a switch operating cam located at the rear end of said rotor, said cam being equipped with a split groove having an interlocking plate inserted and fixed therein in the axial direction of the cam, and wherein said cam has a cylindrical form equipped on its peripheral side sufrace with a cam protuberance, said cam having a compression spring and ball incorporated at its rear end which urge the cam in a forward direction toward said rotor and being caused to slide backward in the axial direction of said rotor when a key is inserted into said rotor; an auxialiary cam rotatably fitted to said switch operating cam, a leaf spring means fixed to said auxiliary cam, and a compression spring provided between said switch operating cam and said auxiliary cam; and a twist coil spring provided with said auxiliary cam in pressure contact with said rear seat plate, whereby said cams are rotated by the key integrally with said rotor in a direction to turn on said switch.

* * * * *